US010535489B2

(12) United States Patent
Freudenberger et al.

(10) Patent No.: US 10,535,489 B2
(45) Date of Patent: Jan. 14, 2020

(54) ANODE

(71) Applicant: SIEMENS HEALTHCARE GMBH, Erlangen (DE)

(72) Inventors: Joerg Freudenberger, Kalchreuth (DE); Anja Fritzler, Roettenbach (DE)

(73) Assignee: Siemens Healthcare GmbH, Erlangen (DE)

( * ) Notice: Subject to any disclaimer, the term of this patent is extended or adjusted under 35 U.S.C. 154(b) by 297 days.

(21) Appl. No.: 15/696,845

(22) Filed: Sep. 6, 2017

(65) Prior Publication Data

US 2018/0075999 A1 Mar. 15, 2018

(30) Foreign Application Priority Data

Sep. 13, 2016 (DE) ..... 10 2016 217 423

(51) Int. Cl.
*H01J 35/12* (2006.01)
*H01J 35/10* (2006.01)

(52) U.S. Cl.
CPC ..... *H01J 35/12* (2013.01); *H01J 35/106* (2013.01); *H01J 2235/1279* (2013.01); *H01J 2235/1283* (2013.01)

(58) Field of Classification Search
CPC .. H01J 35/106; H01J 35/12; H01J 2235/1279; H01J 2235/1283
See application file for complete search history.

(56) References Cited

U.S. PATENT DOCUMENTS 4,165,472 A 8/1979 Wittry
4,866,749 A 9/1989 Uematu
5,541,975 A 7/1996 Anderson et al.
5,737,387 A 4/1998 Smither
6,304,631 B1 10/2001 Snyder
6,430,957 B1 8/2002 Inada et al.
7,197,119 B2 3/2007 Freudenberger et al.
7,440,549 B2 10/2008 Kerpershoek et al.
8,130,807 B2 3/2012 Schulz-Harder et al.
2006/0050852 A1* 3/2006 Andrews ..... F04D 29/588 378/141
2008/0112539 A1* 5/2008 Frenk ..... H01J 35/12 378/141

(Continued)

FOREIGN PATENT DOCUMENTS

CN 104681378 A 6/2015
CN 105229770 A 1/2016
DE 2919153 A1 11/1979

(Continued)

OTHER PUBLICATIONS

Curamik Enabling Power Efficiency—Cooling Solutions—Product Information—Rogers Corporation, 2016, Publication # 135-003, Version 1.16 en.

*Primary Examiner* — Mark R Gaworecki

(74) *Attorney, Agent, or Firm* — Laurence Greenberg; Werner Stemer; Ralph Locher

(57) ABSTRACT

An anode has a base member, on which an X-ray active layer is applied. A first cooling circuit with a first cooling medium extends at least in part in the base member beneath the X-ray active layer. A second cooling circuit with a second cooling medium is arranged beneath the first cooling circuit. The anode exhibits distinctly improved thermo mechanical properties.

14 Claims, 2 Drawing Sheets

(56) References Cited

U.S. PATENT DOCUMENTS

| | | | |
|---|---|---|---|
| 2014/0369476 | A1 | 12/2014 | Harding |
| 2016/0064176 | A1 | 3/2016 | Xiang |

FOREIGN PATENT DOCUMENTS

| | | | |
|---|---|---|---|
| DE | 3827511 | A1 | 3/1989 |
| EP | 1055719 | A1 | 11/2000 |
| EP | 1959528 | A2 | 8/2008 |

* cited by examiner

ANODE

CROSS-REFERENCE TO RELATED APPLICATION

This application claims the priority, under 35 U.S.C. § 119, of German patent application DE 10 2016 217 423.1, filed Sep. 13, 2016; the prior application is herewith incorporated by reference in its entirety.

BACKGROUND OF THE INVENTION

Field of the Invention

The invention relates to an anode.

Such an anode is arranged in an X-ray tube and serves to generate X-rays by bombardment with electrons. The electrons are released from an electron source (cathode with a thermionic emitter or a field emitter) and accelerated by way of a high voltage, which is applied between the electron source and the anode, to the desired primary energy. On impingement of the electrons onto the material of the anode in the region that is occupied by the focal spot, interaction of the electrons with the atomic nuclei of the anode material results in the conversion of around 1% of the kinetic energy of the electrons into X-rays (Bremsstrahlung, decleration radiation) and approx. 99% into heat. The layer in the anode material in which X-rays are obtained on impingement of the electrons is also known as an X-ray active layer. The X-ray active layer is made from a material (anode material) with a high proton number (atomic number) Z, for example tungsten (W, Z=74) or an alloy of tungsten and rhenium (Re, Z=75).

Since about 99% of the kinetic energy of the electrons impinging on the anode (typically approx. 70 keV to at most 140 keV) is converted into heat, temperatures of up to approx. 2,600° C. arise in the region that is occupied by the electron beam (focal spot). Thermal management is thus a significant task for the anode.

The technically planned and constructed region occupied by the electron beam, i.e. the point on the anode at which the primary beam of electrons generated in the cathode impinges in a focal spot may either be stationary (stationary/fixed anodes) or form a focal path (rotating anodes in rotary anode X-ray tubes or rotary piston X-ray tubes).

U.S. Pat. No. 4,866,749 and its German counterpart DE 38 27 511 A1 describe a stationary anode which has a duct in its interior through which water can flow for cooling (internal cooling).

U.S. Pat. No. 8,130,807 B2 and its European counterpart EP 1 959 528 A2 disclose a diode laser assembly with an active cooler. The cooler takes the form of a micro cooler through which a cooling medium (water) flows. The micro cooler thus forms an active heat sink.

U.S. Pat. No. 7,197,119 B2 furthermore discloses a rotary piston X-ray tube, in which the rear side of the rotary anode, which is structurally part of the X-ray housing, is directly cooled by a "stationary" cooling medium in the emitter housing. The thickness of the rotary anode cannot be substantially reduced since materials failure otherwise occurs. Using copper or TZM makes it possible to prevent a critical materials failure and thus cracking, so avoiding a critical loss of vacuum in the tube housing.

U.S. Pat. No. 5,541,975 discloses an X-ray tube with a rotary anode. The rotary anode is arranged on a rotor shaft through which a liquid metal flows, so dissipating heat from the rotary anode.

Chinese published patent application CN 104681378 A furthermore discloses an X-ray tube in which a liquid metal both forms an anode and is also provided as a cooling medium.

United States published patent application US 2014/0369476 A1 finally discloses an apparatus with an X-ray source which is denoted LIMAX (liquid-metal anode X-ray). In this X-ray source, the liquid metal serves both for generating the X-rays and for cooling. The liquid metal is here sealed from the vacuum by a window. The sealing window, for example consisting of diamond, and the liquid metal flowing in the anode thus define the characteristics of the X-rays. Since no measures are provided for locally controlling the temperature of the liquid metal, the achievable temperature of the liquid metal is limited.

SUMMARY OF THE INVENTION

It is accordingly an object of the invention to provide an anode for x-ray applications which overcomes the above-mentioned and other disadvantages of the heretofore-known devices and methods of this general type and of the present invention is that of providing an anode with improved thermo mechanical properties.

With the foregoing and other objects in view there is provided, in accordance with the invention, an anode, comprising:

a base member;

an X-ray active layer disposed on said base member;

at least one first cooling circuit with a first cooling medium extending at least in part in said base member beneath said X-ray active layer; and at least one second cooling circuit with a second cooling medium disposed beneath said first cooling circuit.

In other words, the anode according to the invention has a base member, on which an X-ray active layer is applied, wherein at least one first cooling circuit with a first cooling medium extends at least in part in the base member beneath the X-ray active layer and at least one second cooling circuit with a second cooling medium is arranged beneath the first cooling circuit.

The anode according to the invention comprises a base member on the surface of which an X-ray active layer is applied. The X-ray active layer has a thickness of for example approx. 20 μm to approx. 500 μm. In the operating state, the X-ray active layer is bombarded with electrons which are accelerated towards the anode and focused into an electron beam. On impingement of the electron beam, X-rays (Bremsstrahlung) are generated in the X-ray active layer.

In the base member, at least one first cooling structure, through which a first cooling medium flows, extends beneath the X-ray active layer. The first cooling structure is part of at least one first cooling circuit in which the first cooling medium circulates. The first cooling medium may be heated to elevated temperatures of for example up to approx. 2,000° C.

Depending on the configuration of the anode (for example arrangement of the first cooling circuit and/or of the second cooling circuit) and the particular application, the first cooling structure has for example a height of between 0.2 mm and 200 mm.

According to the invention, at least one second cooling circuit with a second cooling medium extends beneath the cooling structure which forms the first cooling circuit. The second cooling medium is typically water with appropriate additions, for example anticorrosion agent, antifreeze and biocide. Water with polyvinyl alcohol (PVA) as additive to provide antifreeze and/or anticorrosion protection is known from U.S. Pat. No. 6,430,957 and its European counterpart EP 1 055 719 A1.

In the solution according to the invention, the direction and flow rate combined with the admissible high temperature level of the first cooling medium accelerate heat propagation and thus heat dissipation in the region occupied by the focal spot. A large area at a high temperature level is furthermore achieved. As a result, more heat can be transported from the high temperature level in the first cooling circuit (first temperature level) to the second cooling circuit which, relative to the first cooling circuit, has a lower temperature level (second temperature level). At the same time, the high temperature of the first cooling medium reduces thermomechanical stresses both in the X-ray active layer and in the base member, so likewise here extending load limits towards a higher electron intensity. Moreover, the boiling temperature of the second cooling medium (for example water) no longer limits the temperature of the first cooling medium.

This may be explained in simple terms for thermal conduction in a bar-shaped solid with a constant cross-section.

The following applies to thermal conduction in a bar:

$$\delta Q=\lambda\cdot A\cdot\Delta t\cdot\delta T/\delta x$$

where:

δQ denotes the quantity of heat;

λ represents the thermal conductivity;

A is the cross-sectional area;

Δt is the time; and

δT/δx is the temperature gradient.

If the lower temperature of the second cooling medium (for example water) is kept constant at approx. 100° C. and the upper temperature is assumed to be the anode temperature, for example the melting temperature of tungsten TS=3,422° C. or the focal spot temperature TB=2,600° C., the maximum quantity of heat dissipated δQ is obtained from the length of the bar-shaped solid (bar length). The cross-sectional area A can be enlarged with the first coolant (for example liquid metal), meaning that a larger quantity of heat δQ can flow between the temperature level of the first cooling medium (liquid metal) and the temperature level of the second cooling medium (water). Overall, a higher heat flow is thus possible.

The anode as claimed thus exhibits thermo mechanical properties which are distinctly improved over those of known anodes.

Power density in the focal spot is ultimately the decisive factor. If a very small focal spot is selected, then the stated temperatures occur even in the case of quantities of heat of the order of a few watts. The two-level cooling system described here is advantageous in this case too. Here, the second cooling medium may, however, also be a gas or gas mixture (for example air).

The solution according to the invention described in claim 1 is suitable both for stationary anodes (fixed anodes) and for rotary anodes. A rotary feed through unit for the cooling media involved is, however, required in the case of rotary anodes for transferring the first cooling medium and optionally the second cooling medium to the rotating system.

In accordance with an added feature of the invention, the first cooling circuit, in which the first cooling medium circulates, and which, according to the invention, extends at least in part in the base member, preferably comprises at least one first cooling duct which is arranged at least in part in the base member. Forming at least one cooling duct in the first cooling circuit ensures that the cooling medium is purposefully guided to regions in the base member which are exposed to particularly severe thermal loads, such as for example beneath the X-ray active layer.

In contrast to the first cooling circuit which, according to the invention, is arranged at least in part in the base member beneath the X-ray active layer, it is not absolutely essential for the second cooling circuit to extend entirely or in part in the base member. According to the invention, the second cooling circuit merely needs to be arranged beneath the first cooling circuit. For the purposes of the invention, two fundamentally equivalent alternatives are thus possible for the second cooling circuit which are merely dependent on the individual case in question and may also be implemented in combination.

In accordance with a first alternative feature of the invention, the second cooling circuit, in which the second cooling medium circulates, comprises at least one second cooling duct which is arranged at least in part in the base member.

In accordance with a second alternative feature of the invention, the second cooling circuit, in which the second cooling medium circulates, comprises at least one second cooling duct which is arranged outside the base member. The second cooling duct may extend for example in the emitter housing, in which the X-ray tube is arranged, or be formed by the emitter housing itself.

In accordance with again an added feature of the invention, the X-ray active layer contains tungsten. The X-ray active layer may thus consist of pure tungsten (metallic purity for example approx. 99.97 wt. %) or tungsten alloys (for example tungsten-rhenium with an alloy content of for example approx. 1% to approx. 15% rhenium). Tungsten doped with additives (for example with 60 ppm to 65 ppm potassium) should also be understood to be included. The layer thickness of such an X-ray active layer typically amounts to 20 μm to 500 μm.

As an alternative to the solids stated by way of example, the X-ray active layer may also consist of a liquid metal, for example pure gallium or an alloy of gallium, indium and tin. It is here advantageous to use the first cooling medium circulating in the first cooling duct as the material for the X-ray active layer. Possible evaporation of the X-ray active layer may optionally be prevented by a protective layer, for example of diamond.

In accordance with another feature of the invention, the base member of the anode typically consist of a material with a thermal conductivity λ of ≥130 W $m^{-1}$ $K^{-1}$. Materials which achieve or exceed this value at 20° C. (293 K) include for example molybdenum, copper, diamond and TZM (titanium-zirconium-molybdenum) alloys and ceramic, refractory materials such as for example tantalum hafnium carbide ($Ta_4HFC_5$) and silicon carbide (SiC).

If the anode comprises a plurality of first cooling ducts, then according to a preferred variant at least one first cooling duct is arranged at least in part at a distance t of 0.2 mm to 0.5 mm below the X-ray active layer.

The focal spots typically used in medical technology today have a length c of approx. 5 mm to 10 mm and a width d of approx. 1 mm.

In accordance with a further advantageous feature of the invention, at least one first cooling duct has a cross-section Q=a·b, wherein a=0.5 mm and b=1.0 mm. For the purposes of the invention, the cross-section need not necessarily be rectangular. Depending on circumstances or requirements, other cross-sections may also be convenient for at least one first cooling duct. Cross-sections which may be provided as required include for example circular, triangular or oval cross-sections. In the case of a plurality of first cooling ducts, different cross-sections may also be provided for each individual first cooling duct. It may also be advantageous in individual cases not to retain a constant cross-section of the first cooling duct in question but instead, as a function of thermodynamic conditions, to vary this cross-section over the length of the first cooling duct.

In the case of a plurality of first cooling ducts, it is advantageous to arrange the first cooling ducts at a distance a' of 0.5 mm from one another.

When selecting a (width of the first cooling duct) and a' (distance of the cooling ducts from one another), it is important for a to be <c (approx. by a factor of >10), c being the length of the focal spot, and for a' to be <c (approx. by a factor of 10). In addition, a' may be no greater than the distance t between the X-ray active layer and the first cooling structure.

In order to achieve the small distance between the first cooling duct(s) and the X-ray active layer and the small cross-section of the first cooling ducts, and the small distance of the first cooling ducts from one another, use is made, for example, of "additive" manufacturing methods. These include for example 3D printing methods. Manufacturing methods based on diffusion brazing are alternatively also available.

Due to the maximum temperatures which can occur in the X-ray active layer, it is advantageous for the first cooling medium to consist of at least one liquid metal, wherein the liquid metal advantageously contains gallium. The liquid metal may thus be pure gallium (Ga) or for example a eutectic GalnSn alloy (Galinstan®) of 68.5% gallium (Ga), 21.5% indium (In) and 10% tin (Sn).

A preferred embodiment of the anode is characterized in that the first cooling circuit and the second cooling circuit are separated from one another by at least one separator. Arranging at least one separator between the first cooling circuit and the second cooling circuit makes it straightforwardly possible to increase surface area on at least one side, for example by forming grooves or by sand-blasting.

In accordance with again another feature of the invention, the X-ray active layer separated from at least one first cooling circuit by at least one protective layer. Arranging at least one protective layer between the X-ray active layer and at least one first cooling circuit makes it possible to select the material of the X-ray active layer very largely independently of the first cooling medium.

In order to ensure rapid heat dissipation from the X-ray active layer in the operating state, the first cooling medium preferably has a flow velocity $v_S$ of ≥10 mm/s. In this case, the flow velocity per second of the first cooling medium amounts to a multiple of the width of the electron beam. Such a flow velocity of the first cooling medium permits very good cooling of the base member and thus reliable heat dissipation from the X-ray active layer both in stationary anodes and in rotating anodes.

When selecting flow velocity $v_S$, the flow velocity $v_S$ should amount to $>d \cdot 1/s$, wherein d denotes the focal spot width.

The direction of flow of the first cooling medium is preferably oriented substantially perpendicular to the greater extent of the X-ray active layer and thus perpendicular to the longitudinal direction of the X-ray active layer ("cross-current principle").

In order to achieve and maintain an appropriate flow velocity, it is advantageous for a positive-displacement pump, for example a gear pump, to be arranged in the first cooling circuit.

The invention and the advantageous developments thereof bring about a distinct reduction in thermo mechanical stresses within the anode distinct since the temperature gradient occurring during operational heating of the anode is distinctly smaller.

Other features which are considered as characteristic for the invention are set forth in the appended claims.

Although the invention is illustrated and described herein as embodied in a anode, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
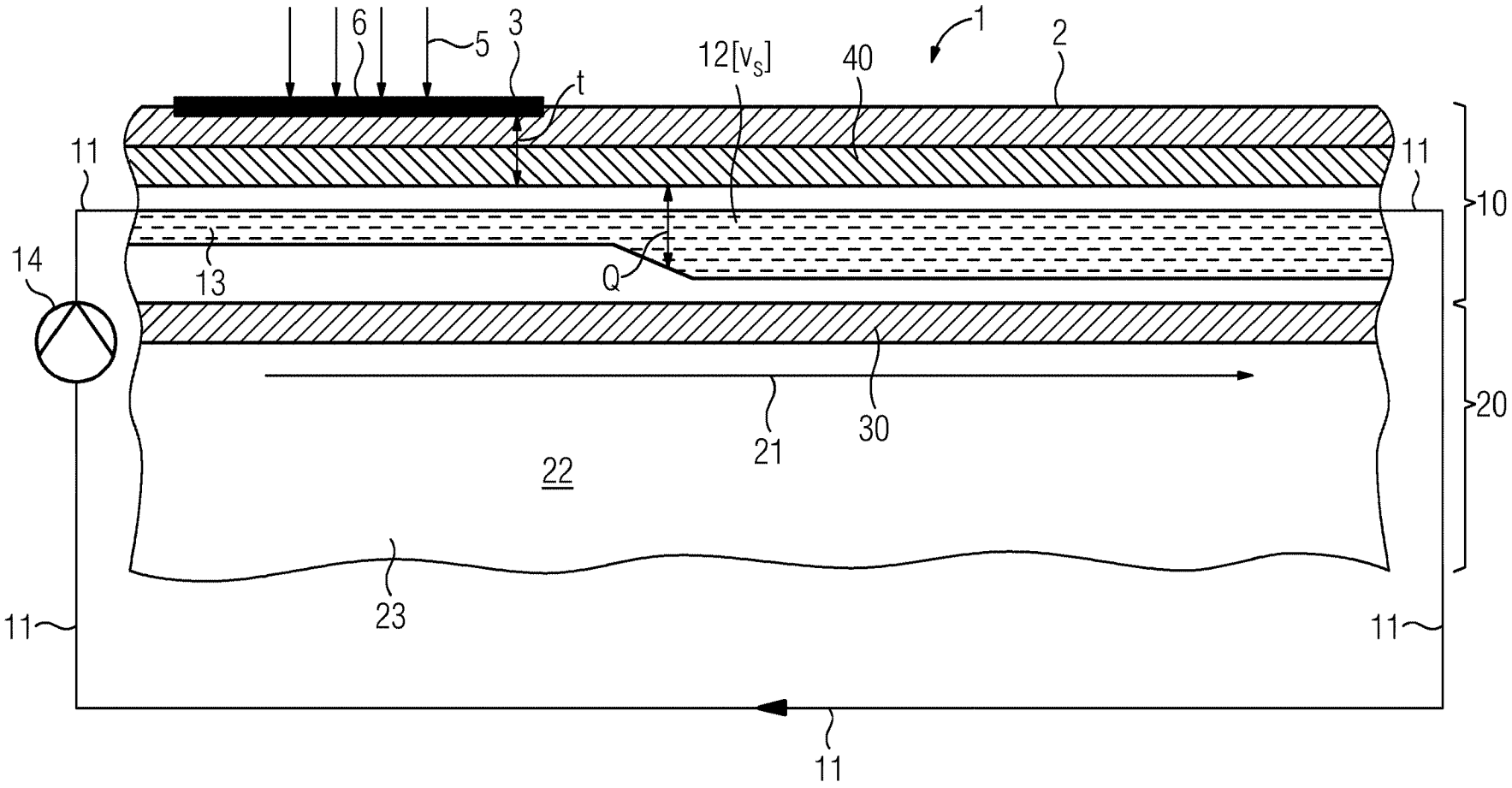
FIG. 1 shows a diagrammatic partial section of a base member of an anode.

Referring now to the figures of the drawing in detail and first, particularly, to FIG. 1 thereof, there is shown an anode 1 which, in the exemplary embodiment shown, takes the form of a stationary anode (fixed anode).

The anode 1 comprises a base member 2 to which an X-ray active layer 3 is applied.

The X-ray active layer 3 consists for example of tungsten and has a thickness of for example approx. 20 μm to approx. 500 μm. In the operating state, the X-ray active layer 3 is bombarded with electrons which are accelerated towards the anode 1 and focused into an electron beam 5. On impingement of the electron beam 5, X-rays (Bremsstrahlung) are generated in the X-ray active layer 3 in a focal spot 6.

The focal spots typically used in medical technology today have a length c of approx. 5 mm to 10 mm and a width d of approx. 1 mm.

According to the invention, at least one first cooling circuit 11 with a first cooling medium 12 extends at least in part in the base member 2 beneath the X-ray active layer 3. Furthermore, according to the invention, at least one second cooling circuit 21 with a second cooling medium 22 is arranged beneath the first cooling circuit 11.

Figure 2:
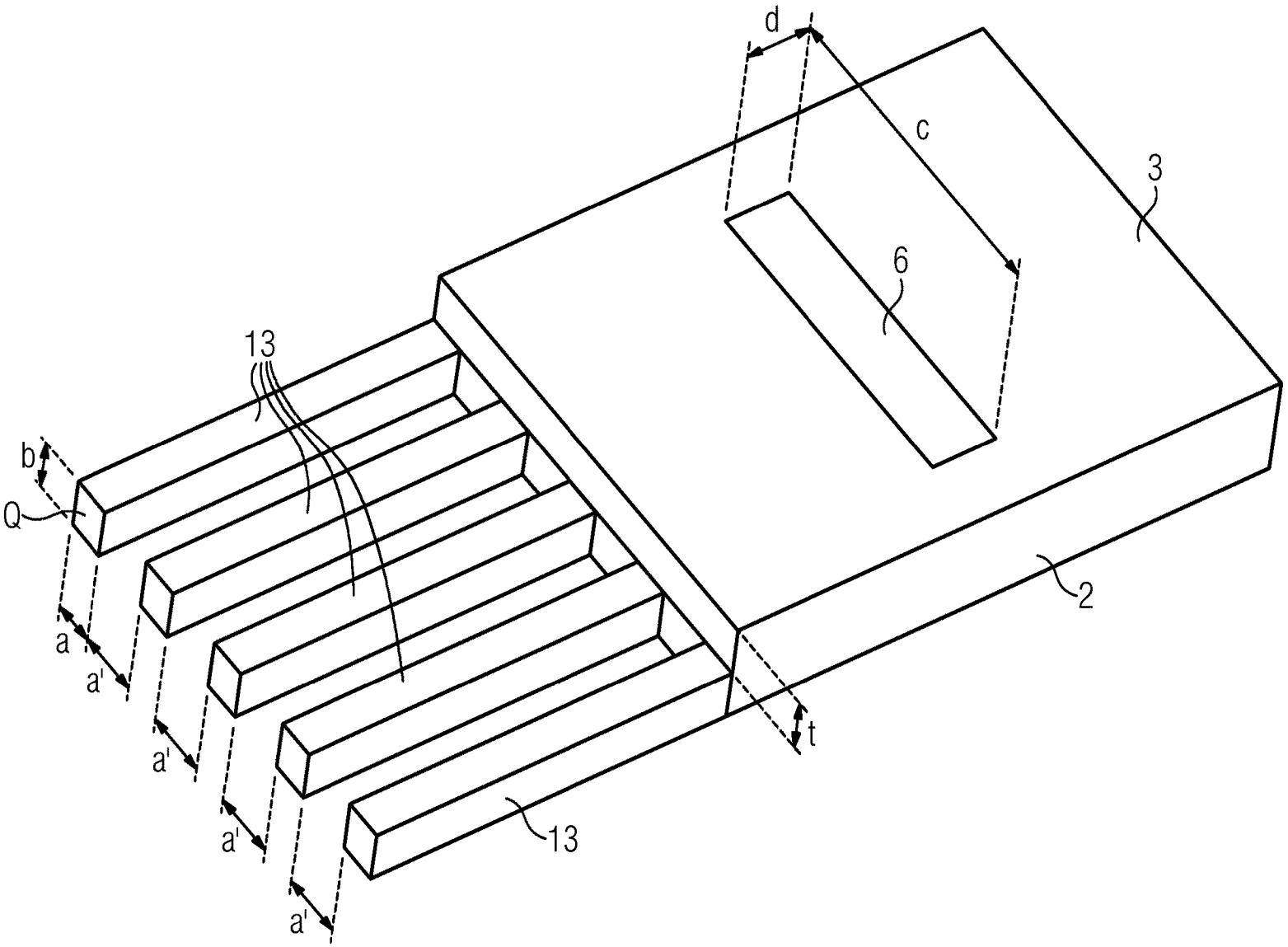
FIG. 2 shows a perspective detail view of a first cooling structure in the base member of the anode according to FIG. 1.

In the exemplary embodiment shown in FIG. 1, the first cooling circuit 11, in which the first cooling medium 12 circulates at a flow velocity $v_S$, comprises at least one first cooling duct 13 which is arranged at least in part in the base member 1. As shown in FIG. 2, the first cooling circuit 11 preferably comprises a plurality of first cooling ducts 13. Because of the selected representation, only one first cooling duct 13 of the first cooling ducts 13 is visible in FIG. 1.

The first cooling circuit 11 thus forms a first cooling structure 10 with a predeterminable number of first cooling ducts 13.

The first cooling medium 12, which for example contains gallium, may be heated to elevated temperatures of for example up to approx. 2,000° C.

The second cooling circuit 21, in which the second cooling medium 22 circulates, furthermore comprises at least one second cooling duct 23 which is arranged at least in part in the base member 2.

The second cooling circuit 21 thus forms a second cooling structure 20 with the second cooling duct 23.

The second cooling medium 22 is typically water with appropriate additions, for example anticorrosion agent, anti-freeze and biocide.

In the exemplary embodiment shown, the first cooling circuit 11 and the second cooling circuit 21 are separated from one another by a separator 30. Arranging at least one separator 30 between the first cooling circuit 11 and the second cooling circuit 21 makes it straightforwardly possible to increase surface area on at least one side, for example by forming grooves or by sand-blasting.

The X-ray active layer 3 is furthermore separated from the first cooling circuits 11 of the first cooling structure 10 by a protective layer 40. Arranging at least one protective layer 40 between the X-ray active layer 3 and the first cooling circuit 11 makes it possible to select the material of the X-ray active layer 3 very largely independently of the first cooling medium 12.

In the solution according to the invention, the direction and flow rate combined with the admissible high temperature level of the first cooling medium 12 accelerate heat propagation and thus heat dissipation in the focal spot 6 (region occupied by the electron beam 5).

In order to achieve the necessary flow velocity for the first cooling medium 12 in the embodiment of the anode 1 shown in FIG. 1, a positive-displacement pump 14 is arranged in the first cooling circuit 11.

A large area at a high temperature level is furthermore achieved. As a result, more heat can be transported from the high temperature level in the first cooling circuit 11 (first temperature level) to the second cooling circuit 21 which, relative to the first cooling circuit 11, has a lower temperature level (second temperature level). At the same time, the high temperature of the first cooling medium 12 reduces thermo mechanical stresses in the X-ray active layer 3, so likewise here extending load limits towards a higher electron intensity. Moreover, the boiling temperature of the second cooling medium 22 (for example water) no longer limits the temperature of the first cooling medium 12 (for example liquid metal).

In the development shown in FIG. 1 of the anode 1 which comprises a plurality of first cooling ducts 13, the first cooling ducts 13 are, as shown in FIG. 2, arranged at a distance t of 0.2 mm to 0.5 mm below the X-ray active layer 3. The maximal possible layer thickness of the separator 40 corresponds to the distance t between the cooling duct 13 and the X-ray active layer 3.

In the embodiment shown, the first cooling ducts 13 have a cross-section Q of 0.5 mm·1.0 mm, wherein the cross-sections Q, as shown in FIG. 2, need not necessarily be rectangular. Depending on circumstances or requirements, other cross-sections may also be convenient for the first cooling ducts 13. Cross-sections which may be provided as required include for example circular, triangular or oval cross-sections. In the case of a plurality of first cooling ducts 13, different cross-sections may also be provided for each individual first cooling duct 13. It may also be advantageous in individual cases not to retain a constant cross-section of the first cooling duct 13 in question but instead, as a function of thermodynamic conditions, to vary this cross-section Q over the length of the first cooling duct 13. In the exemplary embodiment shown in FIG. 1, the first cooling duct 13 has a smaller cross-section Q beneath the X-ray active layer 3 than in the adjoining regions.

In the case of a plurality of first cooling ducts 13, it is advantageous, as shown in FIG. 2, to arrange the first cooling ducts 13 at a distance a' of 0.5 mm from one another.

When selecting a (width of the first cooling duct) and a' (distance of the cooling ducts from one another), a is <c (approx. by a factor of >10), c being the length of the focal spot, and a' is <c (approx. by a factor of 10). In addition, a' may be no greater than the distance t between the X-ray active layer and the first cooling structure.

The direction of flow of the first cooling medium 12 need not necessarily be constant within the first cooling structure 10. Instead, the flow of the first cooling medium 12 within the first cooling structure 10 may vary by an appropriate course of the first cooling ducts 13. Advantageously, the direction of flow of the first cooling medium 12 is oriented substantially perpendicular to the greater extent of the X-ray active layer 3 and thus perpendicular to the longitudinal direction of the X-ray active layer 3 (see FIG. 2).

FIG. 1 and FIG. 2 show a combination of a (miniaturized version of a) liquid metal cooling system (in a first cooling circuit 11) with a water cooling system (in a second cooling circuit 21) in a stationary anode. Due to the rapid passage of the first cooling medium 12 (liquid metal) in the first cooling circuit 11, the cooling area is locally flared.

The invention is, however, not restricted to this exemplary embodiment. Instead, it is straightforwardly possible, on the basis of the described embodiment, for a person skilled in the art also to create other advantageous developments of the inventive concept defined in the following claims.

The solution shown is accordingly suitable not only for stationary anodes but also for rotating anodes (rotary anode X-ray tubes or rotary piston X-ray tubes). At least one rotary transmission lead through, not shown in FIG. 1, for the cooling media involved is necessary in the case of a rotating anode (rotary anode) for transferring the first cooling medium 12 and optionally the second cooling medium 22 to the rotating system.

Combinations of different first cooling media with different second cooling media are furthermore possible for the purposes of the invention.

The invention claimed is:

1. An anode, comprising:

a base member;

an X-ray active layer disposed on said base member, said X-ray active layer including tungsten;

at least one first cooling circuit with a first cooling medium extending at least in part in said base member beneath said X-ray active layer;

at least one second cooling circuit with a second cooling medium disposed beneath said first cooling circuit;

at least one protective layer separating said X-ray active layer from at least one first cooling circuit.

2. The anode according to claim 1, wherein said first cooling circuit, in which the first cooling medium circulates, comprises at least one first cooling duct which is arranged at least in part in said base member.

3. The anode according to claim 1, wherein said second cooling circuit, in which the second cooling medium circulates, comprises at least one second cooling duct which is arranged at least in part in said base member.

4. The anode according to claim 1, wherein said second cooling circuit, in which the second cooling medium circulates, comprises at least one second cooling duct which is arranged outside said base member.

5. The anode according to claim 1, wherein said base member consists of a material having a thermal conductivity $\lambda \geq 130$ W·m-1·K-1.

6. The anode according to claim 1, wherein said at least one first cooling circuit has a plurality of first cooling ducts, and wherein at least one of said first cooling ducts is arranged at least in part at a distance of 0.2 mm to 0.5 mm below said X-ray active layer.

7. The anode according to claim 6, wherein at least one said first cooling duct has a cross-section of 0.5 mm·1.0 mm.

8. The anode according to claim 1, wherein said at least one first cooling circuit has a plurality of first cooling ducts, and wherein said first cooling ducts are arranged at a distance of 0.5 mm from one another.

9. The anode according to claim 1, wherein the first cooling medium consists of at least one liquid metal.

10. The anode according to claim 9, wherein said liquid metal contains gallium.

11. The anode according to claim 1, which comprises at least one separator separating said first cooling circuit and said second cooling circuit from one another.

12. The anode according to claim 1, wherein, in an operating state of the anode, the first cooling medium has a flow velocity vS of ≥10 mm/s.

13. The anode according to claim 1, wherein a direction of flow of the first cooling medium is oriented substantially perpendicular to a major extent of said X-ray active layer.

14. The anode according to claim 1, which comprises a positive-displacement pump arranged in said first cooling circuit.

* * * * *